United States Patent [19]

Naka et al.

[11] Patent Number: 4,996,804

[45] Date of Patent: Mar. 5, 1991

[54] DEVICE AND STRUCTURE FOR SUPPORTING FLOOR PANELS

[75] Inventors: Hiromasa Naka; Takehiko Okushima; Takao Okumura; Tatsuo Shoji; Tetsuo Tobikawa, all of Tokyo, Japan

[73] Assignee: Naka Corporation, Tokyo, Japan

[21] Appl. No.: 518,545

[22] Filed: May 3, 1990

[30] Foreign Application Priority Data

May 17, 1989 [JP] Japan ..... 1-123842
May 17, 1989 [JP] Japan ..... 1-123843

[51] Int. Cl.[5] ..... E04B 9/00

[52] U.S. Cl. ..... 52/126.6; 52/126.1; 52/263

[58] Field of Search ..... 52/126.6, 126.7, 263, 52/126.1, 126.3

[56] References Cited

U.S. PATENT DOCUMENTS

| | | | |
|---|---|---|---|
| 4,074,488 | 2/1978 | Ray, III | 52/126.6 X |
| 4,578,910 | 4/1986 | Germeroth et al. | 52/126.6 X |
| 4,780,571 | 10/1988 | Huang | 52/126.6 X |
| 4,825,603 | 5/1989 | Hardwicke et al. | 52/126.6 |
| 4,922,670 | 5/1990 | Naka et al. | 52/126.6 |

*Primary Examiner*—David A. Scherbel
*Assistant Examiner*—Creighton Smith
*Attorney, Agent, or Firm*—Wenderoth, Lind & Ponack

[57] ABSTRACT

The present invention is a device for supporting floor panels in which when the floor panels are clamped by a single-operation type panel retainer, a retaining member of a vertically swingable panel retainer support on a stud bolt is urged downwardly by the resilient force of a compression spring washer interposed between the upper surface of the retainer member and the lower surface of the head portion of the stud bolt for tightly securing the floor panels to the panel pedestal.

The present invention further provides a structure for supporting floor panels in which a supporting post is swingably raised on the pedestal base plate, side walls of corners of the floor panels placed on the panel pedestal being matchingly engaged with a guide wall of the panel pedestal support and mating projections of said panel pedestal being closely fitted into mating holes formed by embedding resin holders in said floor panels, whereby the floor panels are tightly secured by a panel retainer to the panel pedester.

8 Claims, 6 Drawing Sheets

DEVICE AND STRUCTURE FOR SUPPORTING FLOOR PANELS

BACKGROUND OF THE INVENTION

1. Field of the Invention

This invention relates to a device for supporting floor panels in which a supporting post is raised on a pedestal base plate provided on a reference floor surface, the panels being placed on a panel pedestal at the upper portion of the supporting post and a single-operation type panel retainer and a panel retainer support being engaged with each other, and also to a structure for supporting the panels forming a Rahmen structure.

2. Prior Art

In a conventional device for supporting the floor panels, the supporting post is engaged with and raised on a mating portion of the pedestal base plate fixed to the reference floor surface. The floor panels are placed on a panel pedestal integrally formed on the upper portion of the supporting post and the panels are held between the panel pedestal and the panel pedestal support with the projections formed on the lower end of the panel retainer being engaged with the mating holes formed in the panel pedestal.

Such a conventional device has drawbacks in that the portion of the pedestal base plate requires to have a height for supporting the supporting post and this results in the fact that a relatively large bending moment tends to act on the pedestal base plate to bring down the pedestal base plate. Moreover, in order to permit the clamping operation of the panel retainer, the projections of the panel retainer and the mating holes of the panel retainer support are loosely fitted to each other and this makes it impossible to establish a tight fixing between the panel retainer and the panel retainer support. This will cause further problems in that loosening and rattling may be caused when a person is walking on the panels, and the panel retainer may be loosened or removed by vibration or the like.

SUMMARY OF THE INVENTION

It is an object of the present invention to provide a device for supporting floor panels using a single-operation type panel retainer to allow the floor panels to be tightly clamped and secured to the panel pedestal.

It is another object of the present invention to provide a structure for supporting floor panels forming a Rahmen structure with the floor panels and the device for supporting the latter.

According to the present invention, therefore, there is provided a device for supporting floor panels in which a supporting post is raised on a pedestal base plate provided on a reference floor surface, the panels being laced on a panel pedestal at the upper portion of the supporting post and a single-operation type panel retainer and a panel retainer support being engaged with each other to clamp the floor panels, wherein a retaining member of the panel retainer support is disposed for vertically swinging movement by a collar interposed between it and a stud bolt and wherein a compression spring washer for urging downwardly the retaining member is interposed between the upper surface of the retaining member and the lower surface of a head portion of the stud bolt.

According to the present invention, furthermore, there is provided a structure for supporting floor panels by a plurality of supporting devices positioned on a reference floor surface, wherein a pedestal base plate is fixed to the reference floor surface; wherein a supporting post is raised for swinging movement through an adjusting nut on the pedestal base plate: wherein the supporting post is integrally formed at its upper portion with a panel pedestal on which corner portions of the floor panels are placed: wherein a guide wall of the panel pedestal and side walls of the corners of the floor panels are brought into matching engagement with each other, and mating projections of the panel pedestal are closely fitted into mating holes formed by embedding resin holders in the floor panels and wherein the floor panels are tightly secured by a panel retainer to the panel pedestal.

DETAILED DESCRIPTION OF THE INVENTION

An embodiment of the present invention will now be described with reference to the drawings.

Figure 1:
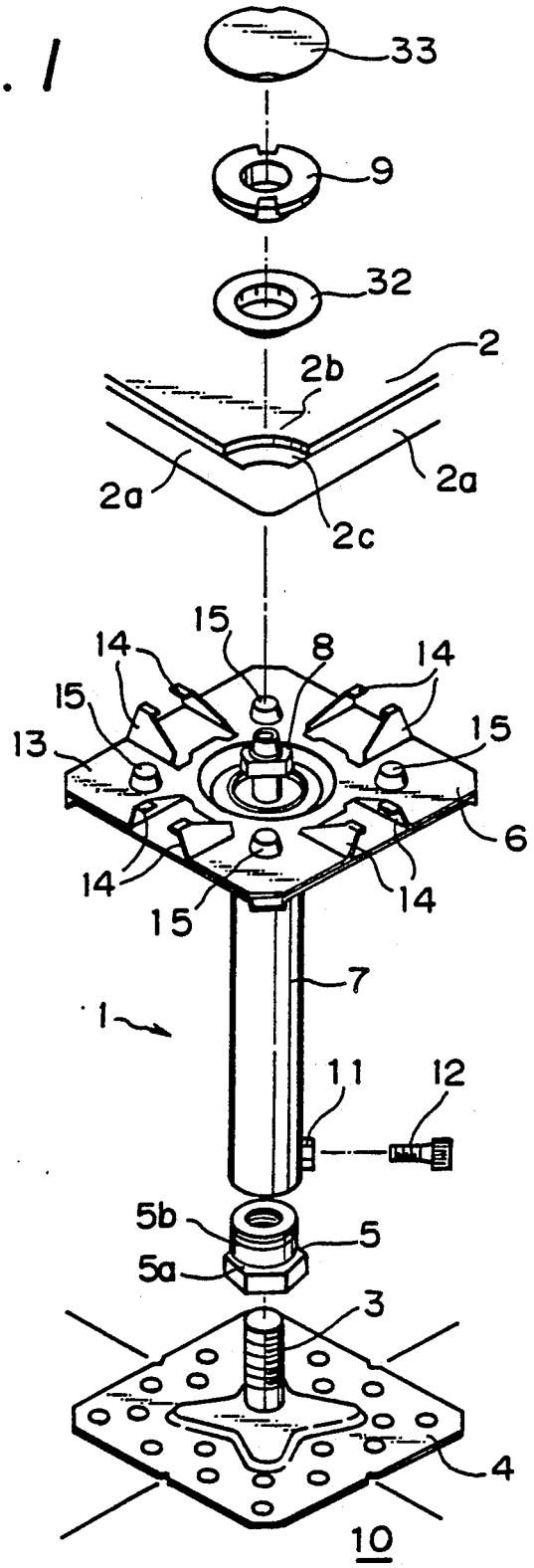
FIG. 1 is a fragmentary perspective view of a floor panel supporting device of the present invention.

Referring first to FIG. 1, there is shown a floor panel supporting device 1 comprising a pedestal base plate 4 integrally provided with a threaded portion 3 centrally on its upper surface, an adjusting nut 5 brought into screw-threaded engagement with the threaded portion 3, a supporting post 7 raised for swinging movement on the adjusting nut 5, the supporting post being integrally provided with a panel pedestal 6 on its upper portion, and a panel retainer 9 engageable with a panel retainer support 8 for tightly clamping floor panels 2.

The pedestal base plate 4 is fixed by suitable means, such as an adhesive agent, to a predetermined position on a reference floor surface 10, and the threaded portion 3 of the base late is brought into screw-threaded engagement with the adjusting nut 5.

The adjusting nut 5 can be rotated to set its level relative to the pedestal base plate 4 and includes a flange portion 5*a* for supporting the lower end of the supporting post 7 and a tapered cone-shaped cylindrical portion 5*b* upwardly reduced in diameter. The supporting post 7 is loosely engaged with the adjusting nut 5 so that it can be raised for swinging movement about its lower end acting as a fulcrum, relative to the pedestal base plate 4. Thus, the supporting post 7 is swingable in any direction relative to the pedestal base plate 4 so that it can always be vertically raised even if there occurs an inclined placement of the pedestal base plate 4. Moreover, the supporting post 7 can be held against removal by a bolt 12 brought into screw-threaded engagement with a nut member 11 provided on the lower end of the supporting post 7.

Figure 5:
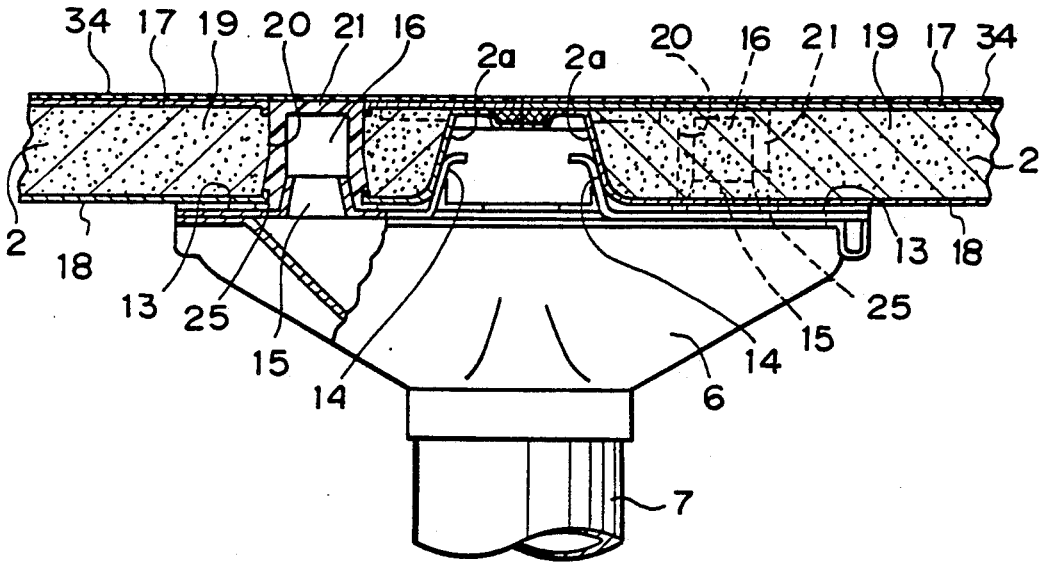
FIG. 5 is a sectional view taken along a line B—B of FIG. 2 showing that condition.

The panel pedestal 6 is formed generally into a square shape and provided with a supporting surface 13 on which ends of four floor panels 2 having a structure as will be described hereinbelow are placed. The supporting surface 13 is formed with guide walls 14 and projections 13 corresponding to the respective floor panels 2. As shown in FIG. 5, each of the guide walls 14 extend at an angle substantially corresponding to the inclined angle of the floor panels 2 and is formed with a horizontally extending upper end which acts to guide a floor panel 2 into position when the latter rests on it and locate the rested floor panel 2 in contact with the side wall 2*a* thereof. The projections 15 are formed by a burring process so that each of the projections can be engaged with a mating hole 16 of one of the floor panels 2 to serve to restrict a horizontal movement of the floor panel 2 and a tilting movement of the supporting post 7.

Each of the floor panels 2 is of a substantially square shape and includes upper and lower panel members 17 and 18 which are opposed to, spaced away from and integrally joined to each other and an inorganic filler 19, such as mortar, sealingly contained in the space. The floor panels 2 are each formed on their corner 2*b* with a stepped portion 2*c* with which the panel retainer 9 is engageable.

Figure 6:
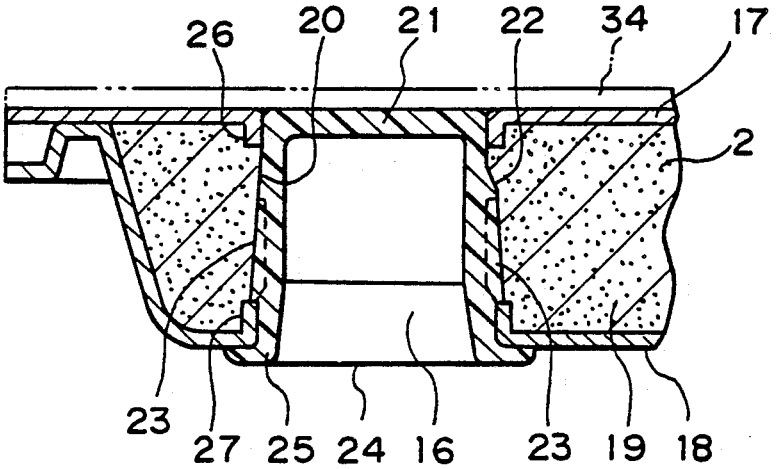
FIG. 6 is a sectional view of the hole area for engagement with the floor panels.
Figure 7:
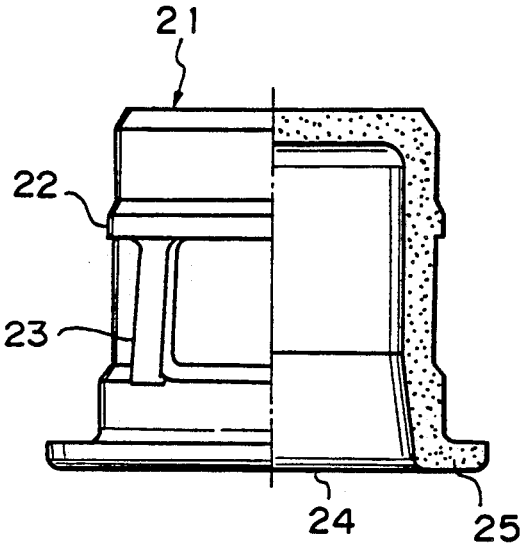
FIG. 7 is a part-sectional view of the holder.

As shown in FIGS. 5 through 7 each of the floor panels 2 is formed at its end portion with a through-hole 20 extending through the panel members 17, 18 and the filler 19, and a holder 21 is embedded in the through-hole 20 to provide the mating hole 16.

The holder 21 is provided on its outer periphery with a rib 22 and a removal-resisting portion 23 and on its lower open portion 24 with a flange 25, and the inner surface of the lower open portion is formed into a tapered configuration. Moreover, the holder 21 is formed to high precision by an injection molding process with a resin. The holder 21 can securely be attached by positioning it in the through-hole 20 prior to the filling of the filler in the molding process of the floor panel and then fitting the contained filler 19 to the rib 22 and removal-resisting portion 23 of the holder 21, and the holder can also be held at its upper and lower end against deformation by burrings 25, 27 formed on the peripheral edges of the upper and lower panels 17, 18 around the through-hole 20.

Such a mating hole 16 defined in the holder 21 facilitates the fitting operation of the floor panels, because its tapered portion acts to guide the mating projection 15 of the panel pedestal 6 when the floor panel 2 is placed. The mating hole 16 and the mating projection 15 are bought into close engagement with each other to prevent the floor panel being horizontally moved and rattled. With the interposition of the holder 21, moreover, any intermetallic contact can be prevented.

Figure 2:
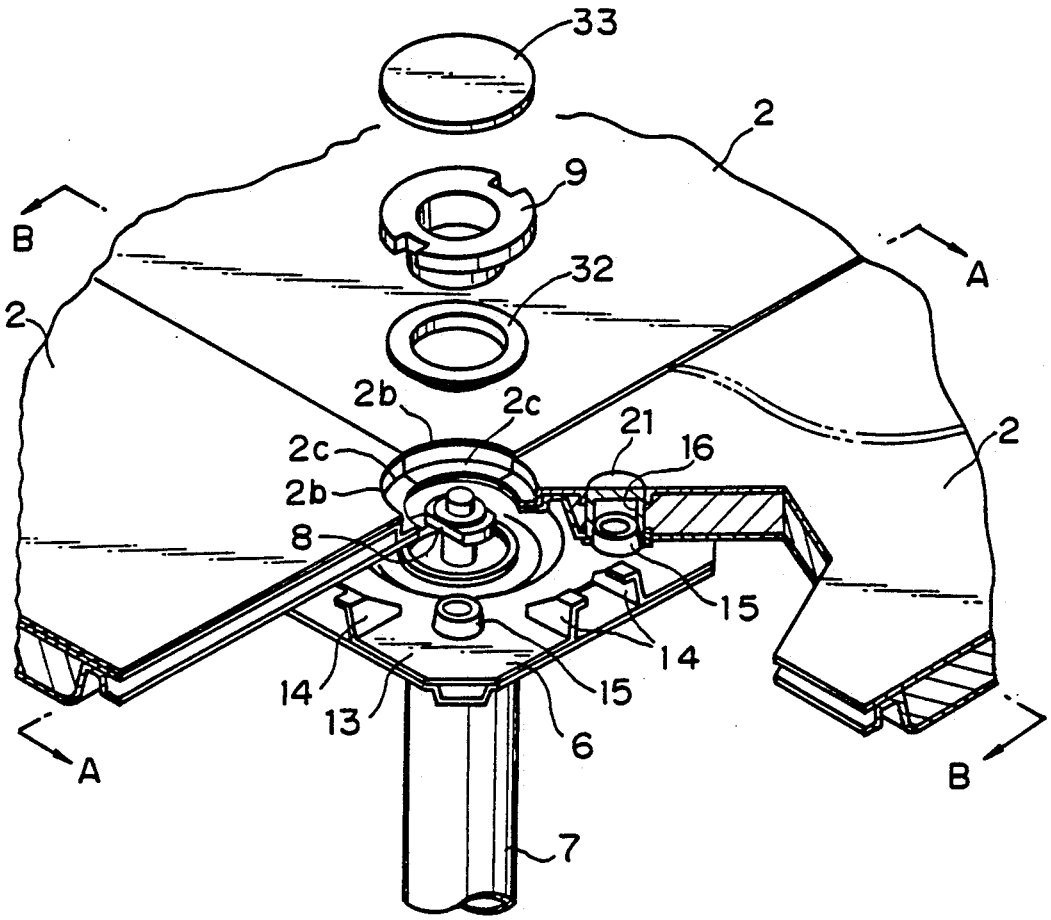
FIG. 2 is an exploded fragmentary part-sectional perspective view of a portion of the device showing a condition that floor panels are mounted on the panel pedestal.
Figure 3:
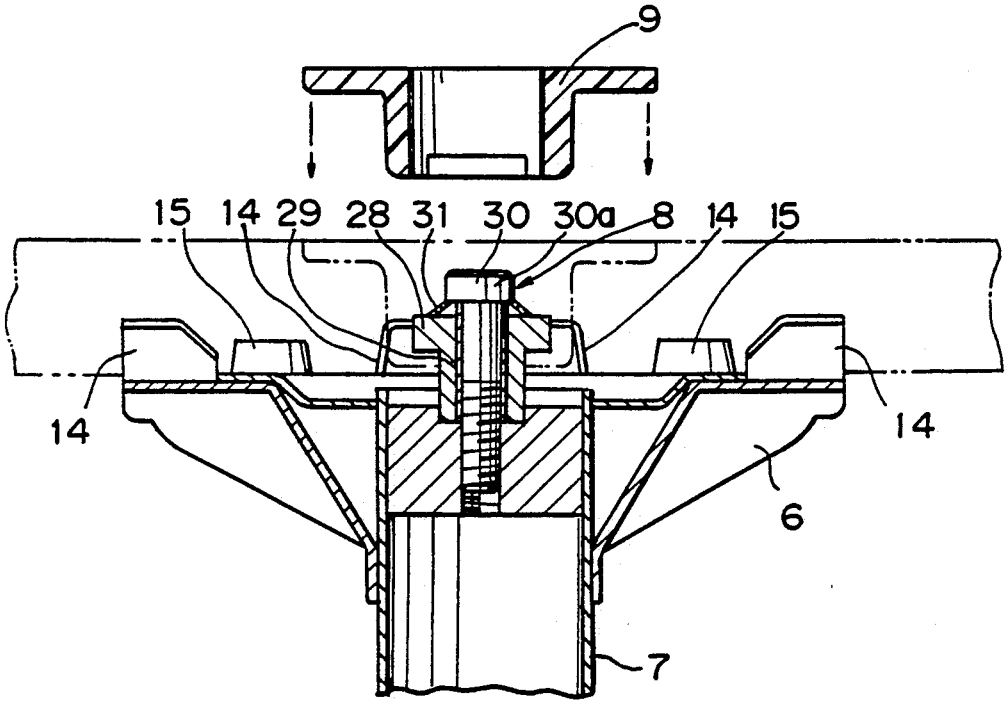
FIG. 3 is a sectional view taken along a line A—A of FIG. 2.
Figure 4:
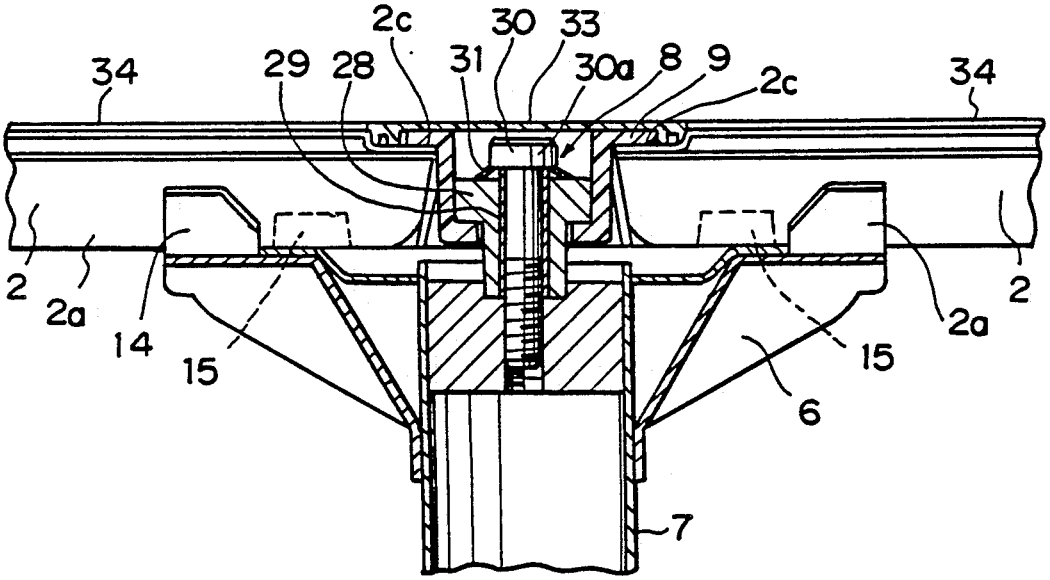
FIG. 4 is a sectional view similar to FIG. 3, but showing the coupled condition of the floor panels to the supporting post.

As shown in FIGS. 2 through 4, four floor panels 2 can be placed together on the panel pedestal 6. At this time, the side walls 2*a* of the floor panels 2 are guided by the respective guide walls 14 of the panel pedestal 6, while the mating holes 16 of the floor panels 2 are guided by the mating projections 15 of the panel pedestal 6, thereby achieving the correct positioning between the floor panels 2 and the panel pedestal 6 and the enhanced integrality of them. Thereafter, the stepped portions 2*c* of the corners 2*b* of the panel can be clamped in a single-operation fashion in which the panel retainer 6 is brought into engagement with the panel retainer support 8.

Figure 8:
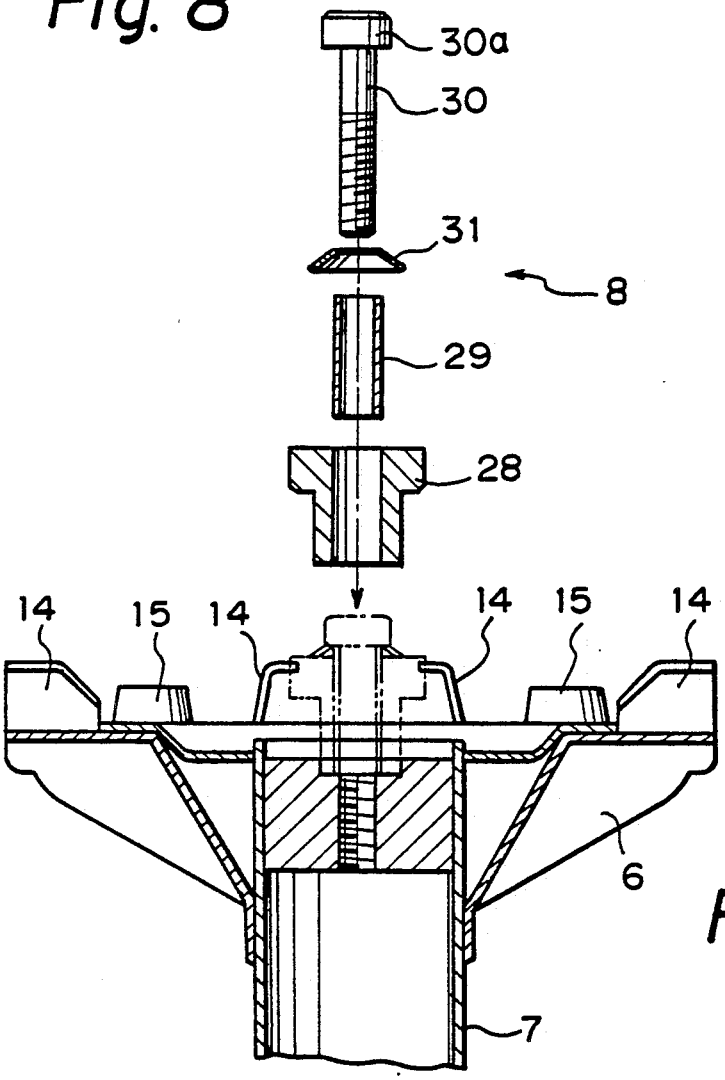
FIG. 8 is an exploded fragmentary view of the panel holding cradle.
Figure 9:
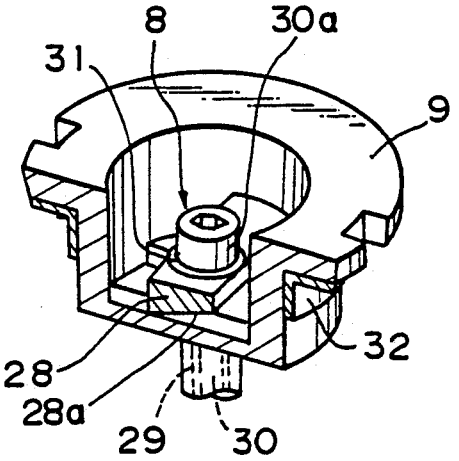
FIG. 9 is a part-sectional perspective view showing the engagement of the panel retainer with the cradle.

The panel retainer support 8 is provided centrally on the upper surface of the panel pedestal 6 in such a manner as shown in FIGS. 8 and 9 wherein a retaining member 28 is slidably inserted with a stud bolt 30 through a collar 29 and a spring washer 31 is interposed between the retaining member 28 and a head 30 of the bolt 30. The panel retainer 9 is engaged with the panel retainer support 8 and the retaining member 28 is then rotated through a predetermined degree of angle (about 90 degrees) so that the retaining member 28 rides up along an inclined surface 28*a* to compress the spring washer 31. The resilient force of the compressed spring washer 31 is then transmitted to the panel retainer 9 to urge the floor panel 2 towards the panel pedestal 6 thereby securing and clamping tightly the floor panels 2 between the panel pedestal 6 and the panel retainer 9 with the flange portions 25 of the holders 21 on the bottom sides of the panels being in abutment with the supporting surface 13. Then, the flange portions 25 of the holders 21 serve as a packing.

Thus, such positive clamping of the floor panels ensures that no loosening and rattling are caused, even when a person is walking on the panels. Moreover, the panel retainer 9 always provides a constant clamping force to prevent loosening or removal of the panels due to vibration or the like caused by the person's passage thereon.

Further provided between the panel retainer 9 and the stepped portions 2*b* of the floor panels is a slide ring 32 for enhancing the sliding ability of the panel retainer 9 and accommodating a difference in the level between the stepped portions 2*b* of the floor panels. Also attached over the upper end of the panel retainer 9 is a cap 33 for finished appearance. In some of the drawings, a carpet 34 is shown spread over the floor panels.

By using the floor panels 2 and the floor panel supporting device 1, as described above, with the floor panels 2 placed on and secured to the panel pedestal 6, an L-shaped Rahmen or rigid frame structure is constructed where the floor panels 2 and the supporting post 7 are rigidly connected to one another. This Rahmen structure is borne on the pedestal base plate 4 through the center point of swinging movement. If the Rahmen structure is subjected to a horizontal load caused by an earthquake or the like, the center of the swinging movement is at the point of contact between the lower portion of the supporting post 7 and the flange portion 5*a* of the adjusting nut 5 closely adjacent to the pedestal base plate 4 (and thus the reference floor surface 10). In other words, a Rahmen structure is formed in which the supporting post 7 is rigidly connected at its upper end to the floor panels 2 and the lower end of the post is provided with a pin connection. Thus, the upper end of the supporting post 7 is affected by a large bending moment, whereas the pedestal base plate 4 only by a small bending moment.

With the present structure for supporting the floor panels, therefore, the pedestal base plate 4 is not subjected to any force sufficient to remove it from the reference floor surface 10, and satisfactory, good and earthquake-proofing performance can be achieved without increasing the adhesive strength of it to the latter.

While there has been described what is at present considered to be preferred embodiment of the invention, it will be understood that various modifications may be made therein, and it is intended to cover in the appended claims all such modifications as fall within the true spirit and scope of the invention.

What is claimed is:

1. A device for supporting floor panels in which a supporting post is raised on a pedestal base plate provided on a reference floor surface, the panels being placed on a panel pedestal at the upper portion of said supporting post and a single-operation type panel retainer and a panel retainer support being engaged with each other to clamp said floor panels, characterized in that a retaining member of the panel retainer support is disposed for vertical swinging movement on a collar interposed between it and a stud bolt, and that a compression spring washer for urging the retaining member downwardly is interposed between the upper surface of the retaining member and the lower surface of a head portion of the stud bolt.

2. A device as set forth in claim 1 wherein said retaining member is raised by an inclined surface formed on the lower surface thereof of rotation relative to said panel retainer.

3. A device as set forth in claim 1 wherein a slide ring is provided between said panel retainer and said stepped portions of said floor panels.

4. A structure for supporting floor panels by a plurality of supporting devices positioned on a reference floor surface, characterized in that a pedestal base plate is fixed to said reference floor surface, that a supporting post is raised for swinging movement through an adjusting nut on said pedestal base plate, that a panel pedestal on which corner portions of said floor panels are placed is integrally formed with said supporting post at its upper portion, that a guide wall of said panel pedestal and side walls of the corners of said floor panels are brought into matching engagement with each other, and mating projections of said panel pedestal are closely fitted into mating holes formed by embedding resin holders in said floor panels, and that said floor panels are tightly secured by a panel retainer to said panel pedestal.

5. A structure as set forth in claim 4 wherein both said guide wall of said panel pedestal and said side wall of said floor panels have the same inclination.

6. A structure as set forth in claim 4 wherein said holders are provided between said floor panels and said panel pedestal to eliminate metallic contact therebetween.

7. A structure as set forth in claim 4 wherein said mating holes of said holders are widened in direction toward its open portion.

8. A structure as set forth in claim 4 wherein said holders are formed with a high precision by an injection molding process with a resin.

* * * * *